US005732750A

United States Patent [19]

Soriano

[11] Patent Number: 5,732,750

[45] Date of Patent: Mar. 31, 1998

[54] METHOD AND APPARATUS FOR BUILDING UP A RAMIFIED HARNESS

[75] Inventor: Louis Soriano, Aubagne, France

[73] Assignee: The Whitaker Corporation, Wilmington, Del.

[21] Appl. No.: 564,297

[22] PCT Filed: Jun. 21, 1994

[86] PCT No.: PCT/FR94/00750

§ 371 Date: Apr. 12, 1996

§ 102(e) Date: Apr. 12, 1996

[87] PCT Pub. No.: WO95/00989

PCT Pub. Date: Jan. 5, 1995

[30] Foreign Application Priority Data

Jun. 28, 1993 [FR] France ..... 93 08161

[51] Int. Cl.[6] ..... B21F 27/12

[52] U.S. Cl. ..... 140/92.1; 29/755

[58] Field of Search ..... 29/868, 872, 755; 140/92.1; 100/2, 8

[56] References Cited

U.S. PATENT DOCUMENTS 4,835,858 6/1989 Adlon et al. ..... 29/868

FOREIGN PATENT DOCUMENTS 0403350 12/1990 European Pat. Off. .

2670618 6/1992 France .

*Primary Examiner*—Lowell A. Larson

*Attorney, Agent, or Firm*—Ladas & Parry

[57] ABSTRACT

The present invention relates to a method and to apparatus enabling electrical wire harnesses to be built up. Apparatus for building up and binding branches (11, 2, 13) of a ramified harness (10) of conductor wire runs (1, 14, 15) comprises at least two colinear main conveyors (18, 26) having a common longitudinal axis ($XX_1$); each of said main conveyors is adapted to displace supports for groups of ends in two opposite directions; said apparatus comprises at least one binding device situated close to one of said conveyors, and it comprises means for permutating the order of the supports of groups of ends along said axis ($XX_1$); said apparatus comprises means for both-way transfer of said supports of groups of ends from one of said main conveyors to the other of said main conveyors, and it comprises means for controlling and monitoring the displacements of said conveyors independently from each other, through predetermined distances. The technical field of the invention is that of manufacturing electrical harnesses.

12 Claims, 7 Drawing Sheets

METHOD AND APPARATUS FOR BUILDING UP A RAMIFIED HARNESS

The present invention relates to a method and to apparatus enabling a harness of electric wires or fibers or tubes or cables (hereinafter collectively and/or generically called wires) to be built up, i.e. to be shaped in particular by binding and/or taping.

The technical field of the invention is that of manufacturing electrical harnesses.

Electrical harnesses are made up of runs of electrically conductive wires whose ends are "processed", i.e. they are generally stripped and provided with crimped tabs and/or engaged in slots of electrical connectors.

The preparation of components for electrical harnesses can be automated, and apparatuses for that purpose are described, in particular, in patent application WO 93/00730 (L'Entreprise Industrielle) which describes apparatuses for inserting and handling electrical wire runs for the purpose of making up electrical wire harnesses; other apparatuses for manufacturing electrical harnesses are also described, e.g. in patent GB 2 087 760 (Yasaki) which describes devices for inserting and preparing the ends of wire runs that are to be used in making up harnesses; in particular, FIG. 8 of that document shows an electric wire harness having a ramified structure comprising a plurality of branches.

In the present application, the term "terminal branches" is used to designate portions of an electrical harness constituted by portions of wire runs whose ends are grouped together to make up an end (called a "free end") of the terminal branch, with the other end of the terminal branch being called a "node" and also constituting an end of another branch; in the present application, the term "central branch" is used to designate a branch extending between two nodes and not having any wire run end, being made up of solely of parts of wire runs and serving to interconnect at least two branches (which may be terminal or otherwise).

FIG. 8 of the above-cited Yasaki patent shows a conventional manner of manually building up electrical harnesses in which wire runs for making up the harness are placed on a work table or surface which may be horizontal and which includes pegs serving for guiding and positioning the various portions and ends of branches in an electrical harness, thus making it possible to hold said branches in position and allowing an operator to bind and/or tape together each of said branches of said electrical harness by hand; that type of apparatus enabling a harness to be built up manually is sometimes referred to as a "peg board".

Tests have been performed to enable the above operations of building up and/or binding and/or taping the branches of electrical harnesses automatically, as described, for example, in patent application EP 403 350 (Aérospatiale).

The apparatus described in that document comprises a horizontal work surface provided and parallel rectilinear guide paths along which pegs and supports can slide, each support holding a connector; the pegs or the supports can be put into place by sliding along the guide paths. The connectors and pairs of pegs are spaced apart from one another along the guide paths, and then pairs of pegs are moved towards each other so as to define nodes in the harness, after which supports are pulled transversely to the guide paths so as to stretch the respective conductors, thus making it possible subsequently to secure the conductors together mechanically so as to form branches of the electrical harness.

A system similar to the above is described in European patent application EP 490 795 (Ricard) which comprises a clamp for placing ties that is itself displaced by a robot provided with an arm; the apparatus further comprises a plurality of parallel conveyors between which slideways are provided parallel to the conveyors and receiving moving abutments which deflect and organize the branches of the harness; the harness to be built up is held firstly at its ends and secondly at its nodes by means of parallel clamps; the clamp for placing ties moves to different points of the parallel conveyors; that apparatus requires operator intervention to remove the built-up harness.

The drawback of the apparatuses described in the above documents is that they are very complex; those apparatuses have a very large number of components (pegs, supports, and binding device) which need to be displaced in two (mutually perpendicular) directions over a plane, and said complex apparatuses are expensive and poorly adapted to producing electrical harnesses entirely automatically.

An object of the invention is to provide apparatus for building up electrical harnesses entirely automatically while enabling complex harnesses to be built up that comprise large numbers of central and/or terminal branches, while nevertheless requiring only a minimum number of moving parts and of displacements or members; another object of the invention is to avoid any need for guide members (or pegs) for use in building up electrical harnesses, and to make it possible to use a binding station which is stationary or which is optionally displaceable in both directions along a single axis only.

The solution to the problem posed consists in providing a method of building up an electrical harness by binding and/or taping together a plurality of electrically conductive wire runs, in which:

the ends or groups of ends of said wire runs or the connectors fitted to said ends or groups of ends of said wire runs, i.e. the free ends of each of the terminals branches of said harness, are disposed in respective supports such as clamps that are displaceable by a first conveyor, preferably constituted by a linear cog belt conveyor having a substantially horizontal longitudinal axis ($XX_1$), which cog drive belt or conveyor for said clamps or supports for groups of ends is driven by a motor such a synchronous stepper motor; and to stretch each of the branches of said harness:

a) a fraction of said clamps or supports holding said free ends of said terminal branches situated to one end, e.g. the left, of the branch to be stretched is transferred in ordered manner and with predetermined relative spacing to a second conveyor extending said first conveyor, i.e. extending along said longitudinal axis ($XX_1$), the clamps or supports holding said free ends of said terminal branches that are situated at the other end, e.g. the righthand end, of said branch to be stretched being disposed or transferred in ordered manner and with predetermined relative spacing of said free ends or of said groups of ends of wire runs onto said first conveyor by increasing branch length; and b) said first conveyor is displaced in a first direction and said conveyor is displaced in a second direction that is substantially colinear or coaxial with, but opposite to said first direction, so as to stretch said branch and the wire run portions making up said branch;

said stretched branch is bound or taped by a binding device.

Advantageously, a method of building up or shaping, in particular by binding, an electrical harness comprising at least two wire runs to form at least three branches separated by at least one node (and meeting thereat), comprises the following steps:

a) said harness is held or maintained via said ends or groups of ends, i.e. each free end of each terminal branch of said electrical harness is held or maintained by a respective support such as a clamp, which clamps or supports are suitable for moving along a preferably horizontal axis ($XX_1$); and b) to stretch each of said branches:

b1) all of said free ends of all of said branches are classified in two disjoint categories, e.g. by means of a computer in which data relating to the configuration of said electrical harness and to the lengths of said runs or of said branches of said harness has been recorded, a first of said category corresponding to those of said free ends of said terminal branches which are situated at one end of said branch to be stretched, and said second category corresponding to those of said free ends of said terminal branches which are situated at the other end of said branch to be stretched;

b2) said ends of said terminal branches belonging to said first category are moved away from said ends of said terminal branches belonging to said second category by relative movement of said supports or clamps along said axis ($XX_1$); and b3) at least one tie is placed on said stretched branch by means of a binding or taping device.

Advantageously, to bind said terminal branches of said electrical harness, the end or the group of ends forming the free end of said terminal branch to be bound is placed on a first conveyor, and all of the other ends or groups of ends forming the ends of all of the other terminal branches are transferred or placed on a second conveyor in alignment with and extending said first conveyor.

The solution to the problem posed also consists in providing apparatus for building up and binding branches of a harness of electrically conductive wire runs, said harness having a ramified or tree structure, each branch of said harness being limited either by two nodes if the branch is a central branch, or else by one node and a group of ends of said wire runs if the branch is a terminal branch, which apparatus comprises at least two main conveyors having colinear belts sharing a common longitudinal axis ($XX_1$) which is preferably horizontal, each of said main conveyors being adapted to displace and/or transport supports for said groups of ends in two opposite directions, which supports may be constituted by clamps for holding the ends of wire runs or groups of ends of wire runs, or else by supports for connectors each receiving one or more of said ends of said wire runs, which apparatus comprises at least one bonding means or device, preferably situated as a stationary station close to one of said conveyors, which apparatus comprises a permutation means or device for permutating the order of said support for groups of ends along said axis ($XX_1$), which apparatus comprises a both-way transfer means or device for transferring said supports for groups of ends from one of said conveyors to the other of said conveyors, which apparatus comprises means for controlling and monitoring the displacements or movements of said conveyors independently from each other through predetermined distances.

Advantageously, the sum of the lengths of said main conveyors is not less than twice the greatest length of said electrical harness.

Advantageously, said apparatus comprises both an "upstream" first main conveyor suitable for entraining clamps for holding the ends or groups of ends of wire runs, and a "downstream" second main conveyor suitable for entraining or transporting said clamps for holding the ends, and said apparatus comprises means for binding parts of wire runs making up a branch, which means are situated close to one of said conveyors, and said apparatus comprises means for transferring said clamps from said first conveyor to said second conveyor, and vice versa, comprises means for ordering said groups of ends and/or said clamps holding said groups of ends, and comprises independent means for driving said first and second main conveyors in two opposite directions so as to enable portions of wire runs constituting branches of said harness to be stretched.

Advantageously, said transfer and permutation means comprise two intermediate conveyors each capable of being essentially constituted by a gear wheel whose teeth are at a pitch substantially equal to the pitch of the corrugations of the cog belts of said upstream and downstream main conveyors, said intermediate conveyors being movable or displaceable along an axis ($ZZ_1$) perpendicular to said longitudinal axis ($XX_1$) of said upstream and downstream main conveyors, which intermediate conveyors are capable of receiving and/or displacing at least one of said supports for groups of ends, each of said intermediate conveyors being suitable for being placed in a first position in which it is in line with said upstream and downstream main conveyors, being interposed between them so as to enable a support for groups of ends to be transferred from the upstream conveyor to the downstream conveyor or vice versa, each of said intermediate conveyors being suitable for being placed in a second position where it is no longer in line with said upstream and downstream main conveyors and where it can serve as a temporary support for a support of groups of ends while a second intermediate conveyor can be placed in said alignment position with said main conveyors so as to enable a support for groups of ends to be transferred, and thus making it possible to permutate the order of said end groups along said longitudinal axis ($XX_1$) of said upstream and downstream main conveyors.

Advantageously, said longitudinal axis ($XX_1$) of said main conveyors and said displacement axis ($ZZ_1$) of said intermediate conveyors are substantially horizontal, lying substantially in a horizontal plane, and the ends or groups of ends of said wire runs are held in a substantially vertical position.

Advantageously said two moving intermediate conveyors are mechanically connected together and are driven by a single actuator.

Advantageously, each of said intermediate conveyors is capable of being driven synchronously and with constant velocity by one of said upstream and downstream main conveyors via a clutching drive device using an Oldham type coupling.

Advantageously, said upstream and downstream main conveyors are conveyors provided with respective endless cog belts and in which said supports for ends or groups of ends of said terminal branches are provided with respective bases having studs suitable for meshing or cooperating with the corrugations of said cog belts of said conveyors, and each of said upstream and downstream main conveyors is driven by means of a synchronous stepper motor, and said apparatus comprises binding means placed close to the end of a selected one of said main conveyors, which end is its end closer to the other main conveyor.

The method and apparatus of the invention for building up electrical harnesses have numerous advantages.

The method and apparatus of the invention make it possible to build up and bind complex harnesses from individual wire runs optionally fitted with end tabs, which runs may be installed manually by an operator in the clamps or supports for the ends or groups of ends of wire runs placed on a conveyor, or may alternatively be placed on said conveyor by an automatic preparation machine located upstream, and/or from groups of wires whose ends have been inserted in connectors and which are capable of being placed manually in clamps for holding groups of ends of wire runs or on supports placed on a conveyor, or else of being delivered by an automatic insertion machine provided upstream.

The present invention makes it possible to build up electrical harnesses by manipulating such a harness solely by automatic displacement of the free ends of its terminal branches, i.e. the ends of branches that are not connected to other branches, which free ends of terminal branches may be constituted either by wires or by groups of wires, optionally fitted with tabs, and may be held in clamps placed on a linear conveyor and each capable of holding one or more ends of wire runs; the free ends of said terminal branches may also be constituted by the ends of wires that are grouped together and inserted in slots of connectors, in which case a free end can be handled by means of a connector support which is likewise adapted to be placed on and displaced by the same linear conveyor.

The method and apparatus enable harnesses to be built up without putting any limit on the number of wire runs, nor on the number of central branches, nor on the number of terminal branches, with the branches of the harness being built up and put into place and being bound together by moving groups of ends, i.e. free ends of said terminal branches, along a common axis that is preferably horizontal, and in contrast to a system of the kind described in EP 403 350 which requires movements along two perpendicular directions to build up the harness and the branches of said harness and which does so by imitating apparatuses that are operated entirely manually for building up and binding electrical harnesses.

The binding method and apparatus of the invention are applicable to any type of harness however complex, providing the harness has a ramified or tree structure; in the present application, the term "stretching a branch" of an electrical harnesses consists in spacing apart the ends of the branch, and more precisely in spacing apart the free ends of terminal branches at distances that are substantially equal to the length of a wire run whose two ends are grouped together respectively in the two free ends of the terminal branches in question, without that necessarily meaning that any mechanical tensile stress must actually be applied to any of the wire runs of the electrical harness.

In the present application, the term "node" refers to a point where at least three branches of the harness join, are bounded together, or are mechanically attached together, and all or some of which branches may be constituted by central branches or by terminal branches.

In the present application, the term "branch" relates to a part of an electrical harness constituted by portions of one or more electrically conductive wire runs, which portions of wire runs are generally substantially parallel to one another, being kept substantially in contact with one another, in particular by taping, and are intended to be mechanically bound together by at least one tie or binding.

The numerous advantages provided by the invention will be better understood from the following description which refers to the accompanying drawings which have no limiting character and which show particular implementations of the method and the apparatus of the invention for building up electrical harnesses.

Figure 2:
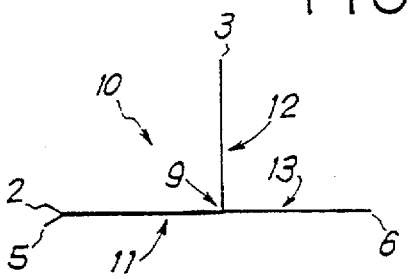
FIG. 2 is a diagrammatic view of the FIG. 1 harness showing another drawing convention.
Figure 4:
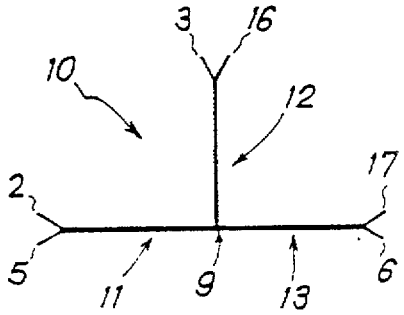
FIG. 4 shows the FIG. 3 harness using another drawing convention identical to the convention used in FIG. 2.
Figure 7:
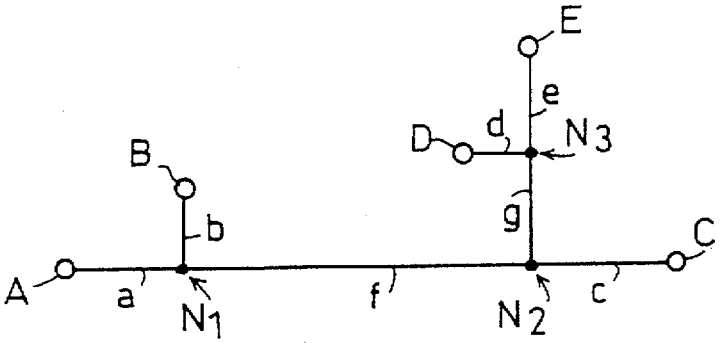

FIG. 7 uses a drawing convention substantially identical to that of FIGS. 2 and 4 and shows a harness that is substantially more complex.

FIGS. 8 to 14 show the successive steps in building up the harness shown in FIG. 7.

FIGS. 15 to 20 show the operations of permutating groups of ends along the general axis of building-up apparatus of the invention.

Figure 6:
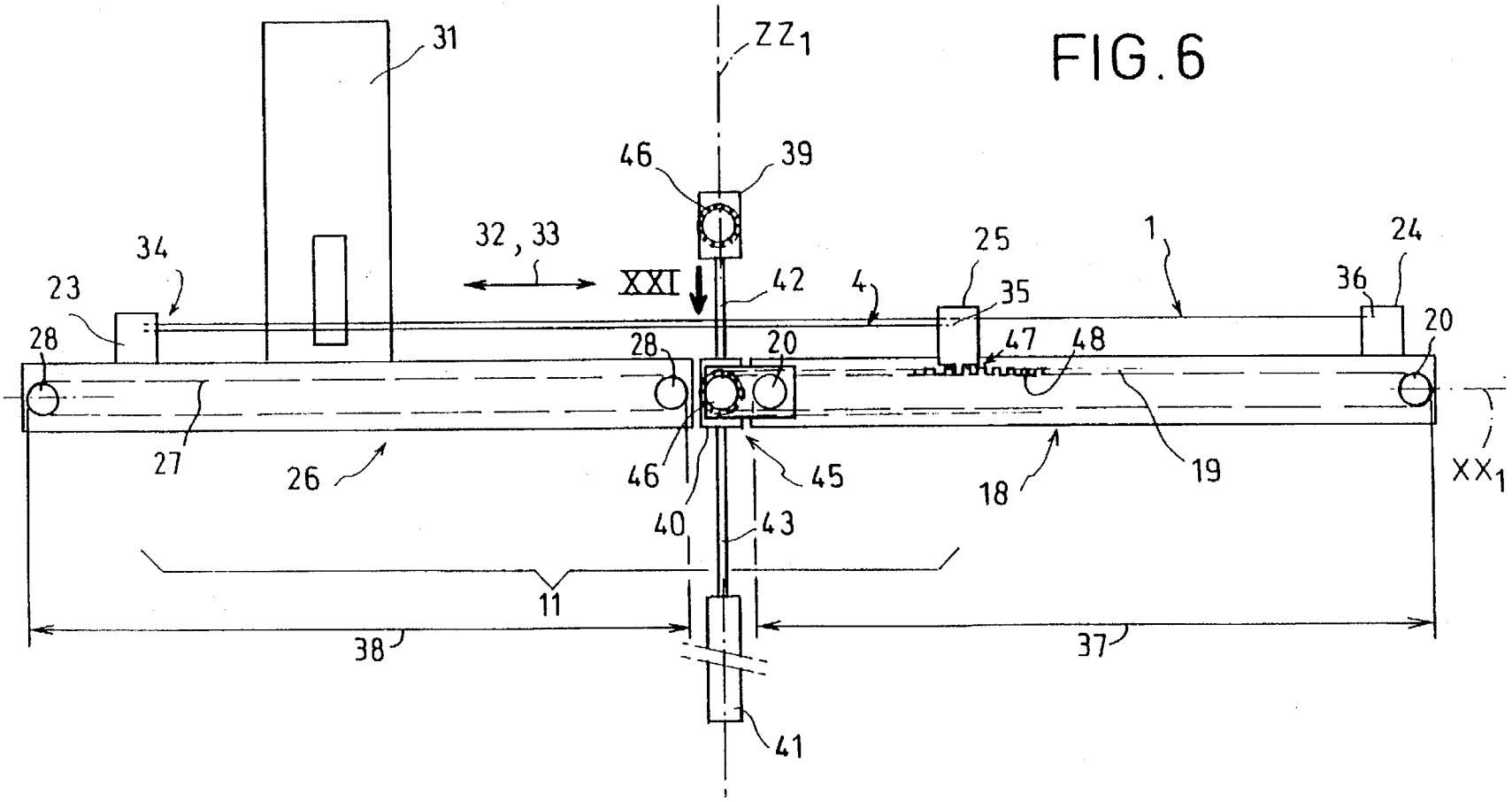
FIG. 6 shows some of the operations in a building-up method of the invention together with the main components of building-up apparatus of the invention.
Figure 21:
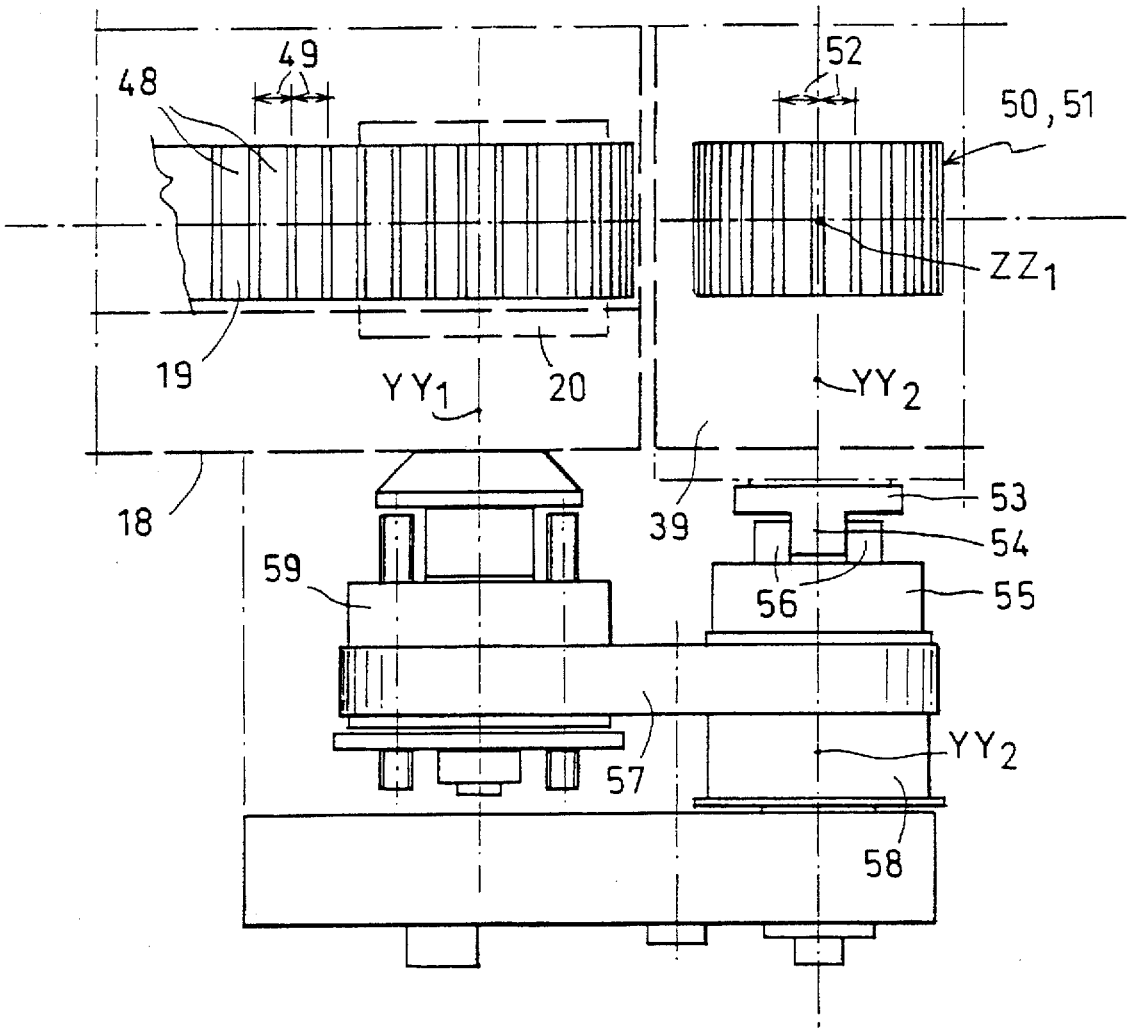

FIG. 21 shows a particular embodiment of a portion of the transfer and permutation means together with their means for driving them from one of the main conveyors of apparatus of the invention, FIG. 21 being a view on XXI of FIG. 6.

Figure 22:
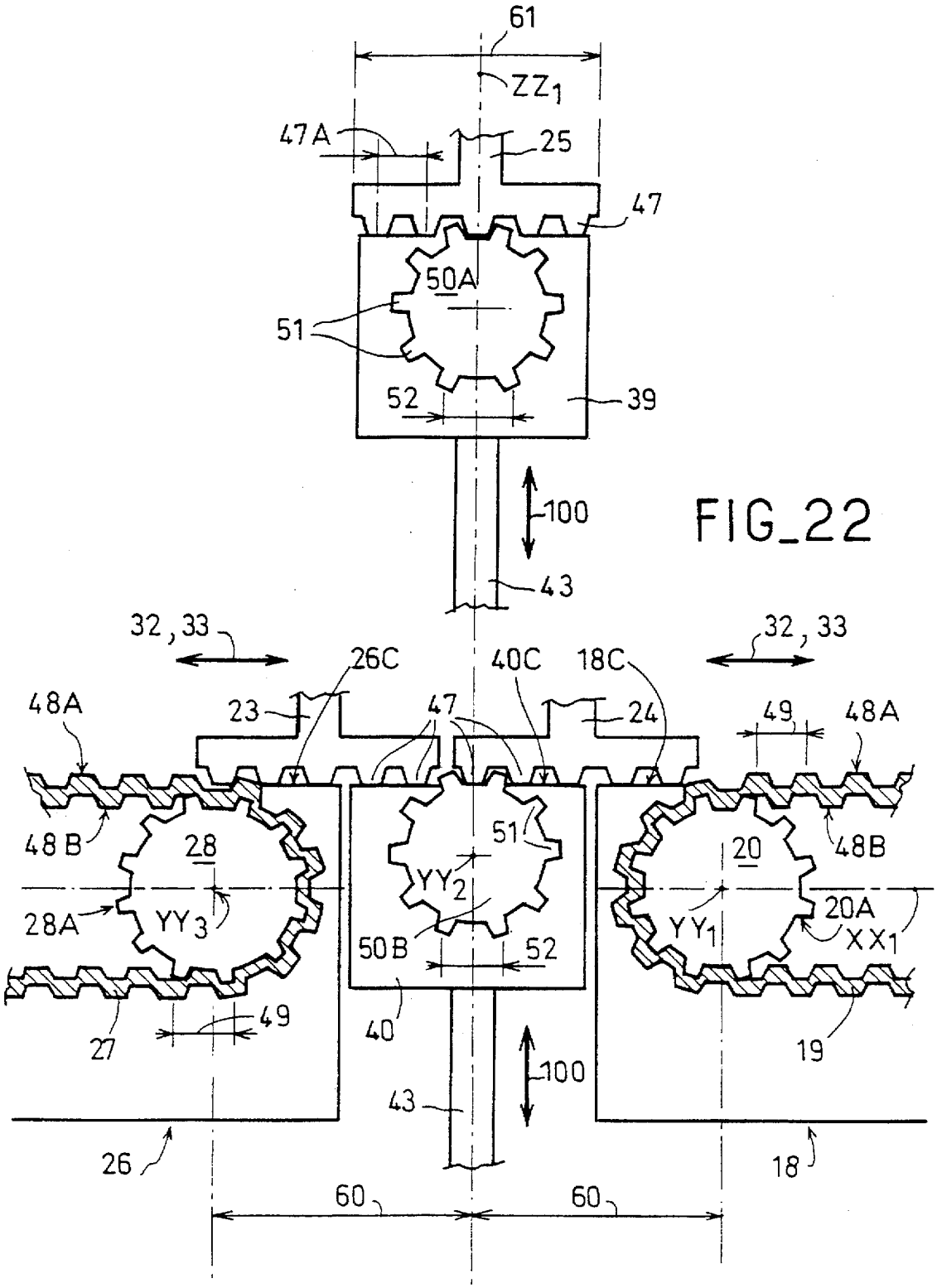

FIG. 22 is a longitudinal view showing an implementation detail of the transfer of permutation means.

Figure 1:
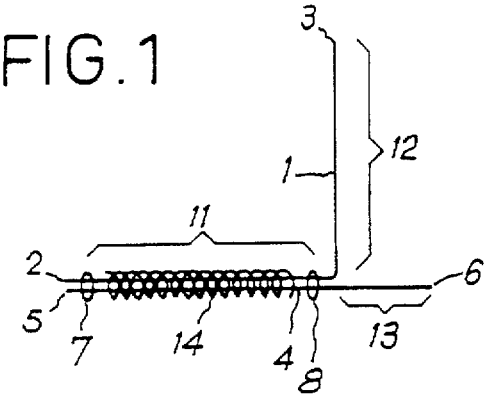
FIG. 1 is a diagrammatic view of a very simple harness constituted by two runs of wires.

FIGS. 1 and 2 are drawn in two different drawing conventions but show the same very simple harness 10 comprising three branches 11, 12, and 13 that are joined together at a node 9.

As shown in FIG. 1, the said harness is constituted by a first electrical conductor 1 whose ends 2 and 3 may optionally be provided with tabs, and a second run of electrical wire 4 whose ends 5 and 6 may optionally be provided with tabs.

In order to make up the harness shown in FIGS. 1 and 2, the said runs of wire 1 and 4 must be assembled in such a manner that said ends 2 and 5 are grouped together close to each other, and that a portion of said wire runs 1 and 4 are likewise grouped together over a fraction of their length by ties or binding 7 and 8 shown diagrammatically and serving to make up a branch 11 suitable for being wrapped in tape 14 so as to give it a certain amount of stiffness and so as to protect and assemble together the corresponding wire run portions.

Figure 3:
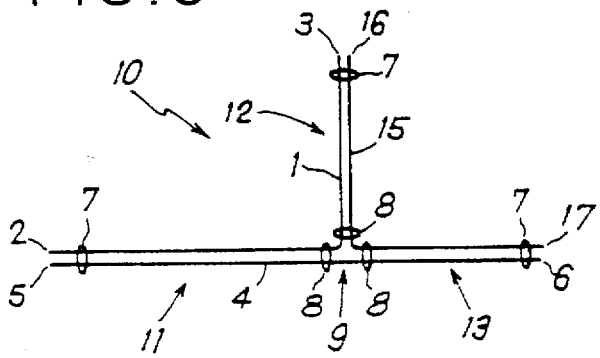
FIG. 3 is a diagram of a second harness which is likewise very simple and is constituted by three runs of wires.

Said tie 8, which may be referred to as an intermediate tie, is situated close to the node 9 (see FIG. 2). FIGS. 3 and 4 show another very simple harness which includes, additionally to the harness shown in FIGS. 1 and 2, a third wire run 15 provided with two ends 16 and 17 that are grouped together respectively with the end 3 of said wire run 1 and with the end 6 of said wire run 4.

A harness is thus obtained having three branches 11, 12, and 13, with each of said branches being made up of an assembly of portions of said wire runs 1, 4, and 15 held together by ties 7 and 8.

In FIG. 4, it can be seen that said branches 11, 12, 13 are joined together, theoretically at a point 9 referred to as a node, which node is generally physically embodied (as shown in FIG. 3) by the mechanical joining together of the three branches that is implemented by installing ties 8 close to the meeting point or node of the three branches.

Figure 5:
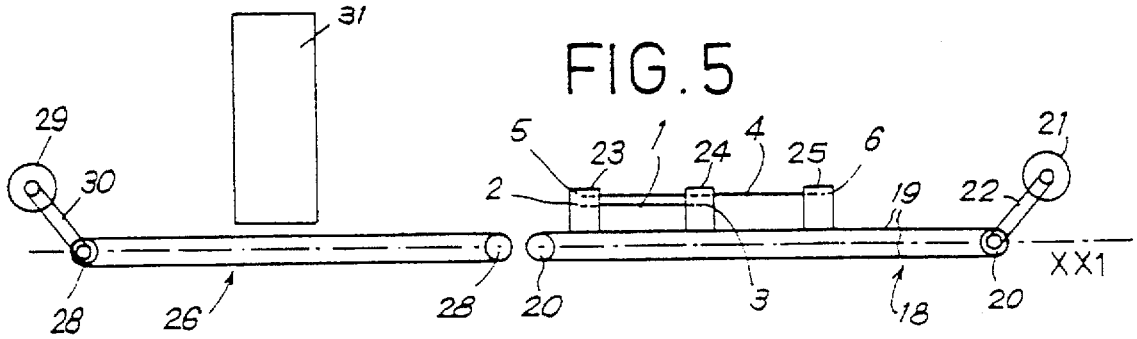
FIG. 5 is a diagrammatic longitudinal view of a portion of building-up apparatus of the invention.

As shown in FIG. 5, apparatus of the invention includes two main conveyors 18 and 26 which are preferably of the endless belt type, with said endless belts preferably being constituted by belts that have cogs on their outside faces at least, which belts are tensioned between respective pairs of rollers 20 and 28 and are driven by rotating at least one of the rollers in each pair, the roller being driven by a respective motor 21 or 29 and a drive belt 22 or 30, which motors 21 and 29 are preferably synchronous stepper motors enabling the respective endless belts to be moved accurately forwards or backwards and which have supports 23, 24, and 25 disposed thereon for groups of ends.

Said conveyors 18 and 26 are placed substantially in line with each other, i.e. they extend along a common longitudinal axis $XX_1$ which is preferably horizontal.

A preferably stationary binding machine or station 31 is located close to said conveyor 26 which is referred to as the downstream conveyor relative to said conveyor 18 which is referred to as the upstream conveyor and on which said support 23, 24, and 25 are disposed for holding the ends of the wire runs or groups of ends of wire runs forming said free ends of the harness to be built up; said supports 23, 24, and 25 holding said free ends (or groups of ends) may be placed manually on one of said conveyors or else they may be transferred automatically by apparatus of the kind described in above-mentioned application WO 93/00730.

Clamps for holding the ends or groups of ends may, for example, be of the type described in patent application FR 87/11392 (Automatismes et Robotique Appliques ARA), and when the ends are fitted with connectors, the supports for groups of ends, i.e. free ends of said terminal branches, may be constituted by supports described in patent application FR 2 671 236 (L'Entreprise Industrielle); such supports, which may be constituted by clamps or connector supports, are generally referred to in the present application by the term "end group" support or by the term "terminal branch free end" support.

With reference to FIGS. 5 and 6, said wire runs 1 and 4 that are to make up the harness shown in FIGS. 1 and 2 and which are situated on said upstream conveyor 18 can have their ends permutated and transferred in part at least to the conveyor 26 in application of the steps described in FIGS. 15 to 20. With reference to FIGS. 15 to 20, it can be seen that the apparatus includes said upstream and downstream conveyors 18 and 26 located in line with each other and separated by a device for transferring and permutating the order of the end group supports or terminal branch free end supports, which permutation and transfer means may be essentially constituted by two very small intermediate conveyors 39 and 40 capable of moving between two positions by linear actuator 41:

- a first position where one of the intermediate conveyors, e.g. 39 (see FIG. 19) is interposed between the two conveyors 18 and 26 and is placed in line therewith, enabling the terminal branch end support to be transferred from one of said conveyors 18, 26 to the other by rotating the drive means of said intermediate conveyor;
- a second position (see FIG. 17) where said intermediate conveyor 39 is displaced (vertically relative to FIG. 17) perpendicularly relative to the longitudinal axis of said upstream and downstream main conveyors 18, 26, said intermediate conveyor 39 serving as a temporary support for said terminal branch free end support 25 and enabling the second intermediate conveyor 40 to take up a position in which said intermediate conveyor 40 is interposed between said conveyors 18 and 26, enabling another end group or terminal branch free end support 24 of the harness to be built up to be transferred from one of said conveyors 18, 26 to the other.

Figure 16:
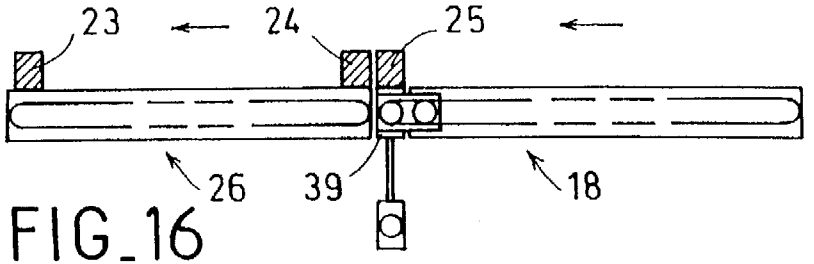
Figure 18:
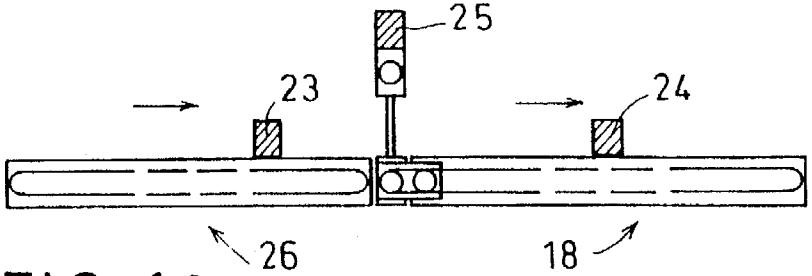
Figure 15:
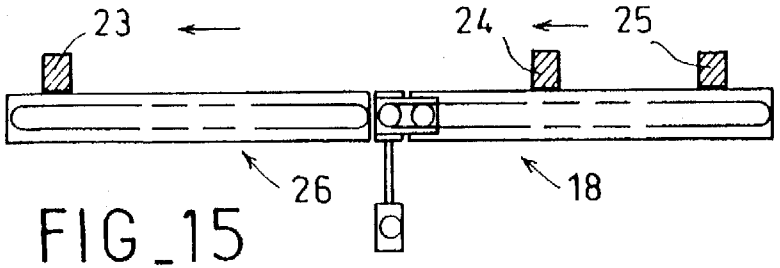

With reference to FIG. 15, in this position, said conveyor 26 carries said end group support 23 and said conveyor 18 supports said end group supports 24 and 25; the two conveyors 18 and 26 are set into rotation so as to cause said supports 23, 24, and 25 to move to the left; with reference to FIG. 16, said intermediate conveyor 39 which is driven synchronously with said conveyor 18 by means shown in particular in FIG. 21 serves to transfer said support 24 from said conveyor 18 to said conveyor 26, and subsequently receives said support 25.

Figure 17:
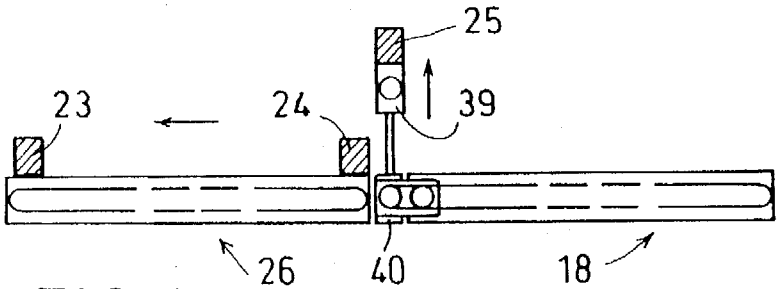

With reference to FIG. 17, the permutation device is actuated, thereby causing said intermediate conveyor 39 supporting said support 25 and said conveyor 40 to be moved upwards, thereby bringing the conveyor 40 into a position enabling it to transfer, i.e. return said support 24 from the conveyor 26 (FIG. 17) to the conveyor 18 (FIG. 18) by said conveyors 18 and 26 moving to the right.

Figure 20:
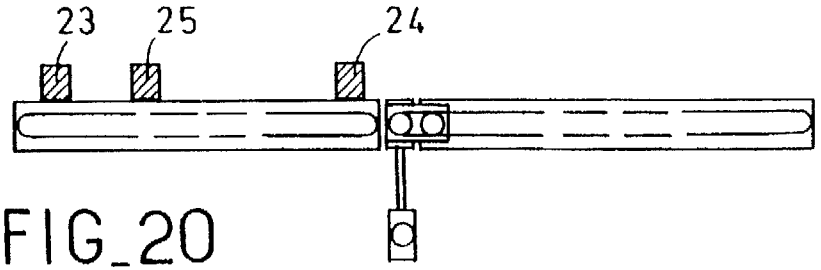
Figure 19:
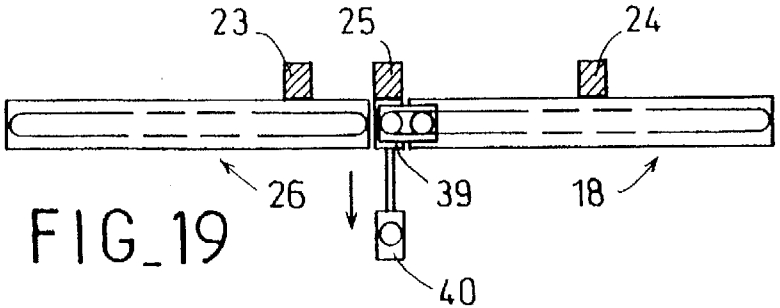

With reference to FIG. 19, said transfer and permutation device is subsequently actuated so as to lower the intermediate conveyors 39 and 40 until said conveyor 39 returns to the intermediate position between said conveyors 18 and 26, after which said conveyors 18 and 26 are actuated to cause displacement to the left relative to FIGS. 19 and 20, thereby serving to transfer firstly said support 25 from said intermediate conveyor 39 to said downstream conveyor 26, and then to transfer said support 24 from said conveyor 18 to said conveyor 39 and then from said conveyor 39 to said conveyor 26.

By means of these permutation operations, it is possible to displace the end groups of the harness shown in FIG. 5 to a position shown in FIG. 6 in which a portion at least of a branch 11 made up of parts of wire runs 1 and 4 is placed facing a binding station 31 situated close to the downstream conveyor 26, the end groups 34 (grouping together said ends 2 and 5 of said runs 1 and 4 respectively) which is held by said end group support 23 being situated to the left of said binding station, i.e. to the left of the branch 11 that is to be stretched on said conveyor 26, and said end supports 25 and 24 (respectively for the ends 6 and 3 of said wire runs 4 and 1) are situated on said upstream conveyor 18 to the right of the branch 11 to be stretched. Respective movements of said conveyors 26 and 18 in the opposite directions of arrows 33 and 32 enables said end groups or end groups 23, 25, and 24 to be placed in positions in which the wire runs 4 and 1 are substantially stretched as shown in FIG. 6, thereby enabling the branch 11 to be bound and/or taped.

In particular when apparatus of the invention is provided that has only one binding station 31 suitable for binding the wire run parts presented thereto in a relatively small zone, it is necessary for the sum of the lengths 38 and 37 of the conveyors 26 and 18 respectively to be not less than twice the longest harness to be built up, and in this case the length of wire run 1 which is the longest run of the harness in the present example.

FIG. 7 is a diagram of an electrical harness that is rather more complex than the harness of FIGS. 1 to 4, and the operations of building it up and taping it are described in detail with reference to FIGS. 8 to 14.

With reference to FIG. 7, said harness comprises five end groups A, B, C, D, and E, and three nodes N1, N2, and N3; said harness is made up of five terminal branches a, b, c, d, and e, respectively connecting said end groups A, B, C, D, and E to said nodes N1, N1, N2, N3, N3, and two central branches f and g respectively interconnecting said nodes N1 and N2 and said nodes N2 and N3.

In FIGS. 8 to 14, said harness is shown diagrammatically and said main conveyors 18 and 26 are shown diagrammatically beneath said harness with their travel directions being represented by arrows. In these figures, the end groups (represented by circles) situated to the left of the vertical dashed line between said conveyors 18 and 26 are considered as being carried by said downstream conveyor 26, whereas said end groups situated to the right of said dashed line are assumed to be displaced by said upstream conveyor 18 to the right in FIGS. 8 to 14, whereas said first ends are displaced to the left in the same figures.

Likewise, although some of the branches are shown as being L-shaped, that has no particular significance and is solely for the purpose of making the figures easier to read.

With reference to these figures, the position measured along the common longitudinal axis of said main conveyors 18 and 26 is represented on the assumption that the length of said terminal branch (a) is greater than the length of said terminal branch (b), and the length of said terminal branch (c) is less than the sum of the length of said terminal branch (d) plus said intermediate branch (g); the length of said terminal branch (e) is assumed to be greater than the length of said terminal branch (d).

Figure 8:
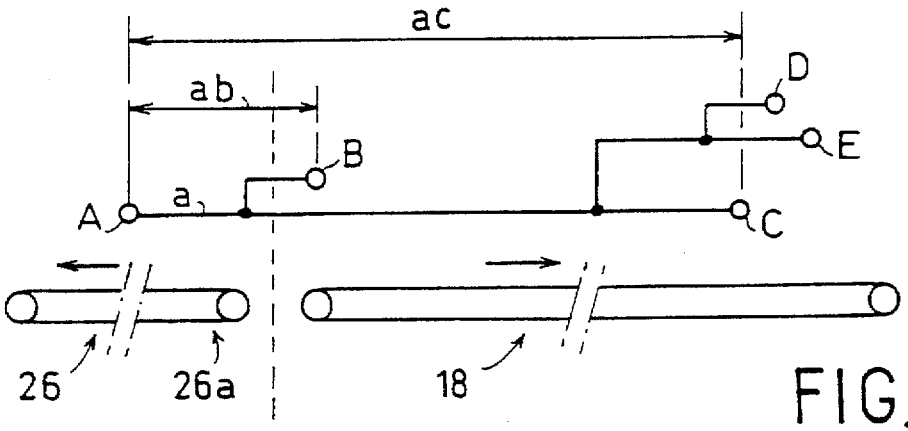

With reference to FIG. 8, in order to stretch terminal branch (a) and enable it to be bound in a zone situated close to the end 26*a* of said conveyor 26, which end 26*a* is situated close to said conveyor 18, i.e. the other main conveyor, end group A is moved or transferred onto said conveyor 26 and it is displaced to the left to a predetermined position, and end groups B, C, D, and E are transferred onto said conveyor 18 and they are displaced to the right to a determined position while maintaining spacing between said end groups B, C, D, and E so that all of the wire runs making up the harness are substantially stretched; in the present case, and by way of example, the distance between end group A and end group B, referenced ab in FIG. 8 is equal to the sum of the lengths of terminal branches (a) and (b); in similar manner the distance referenced ac in FIG. 8 between said end groups A and C is substantially equal to the sum of the lengths of said terminal branches (c) and (a), plus the length of said central branch (f).

Figure 9:
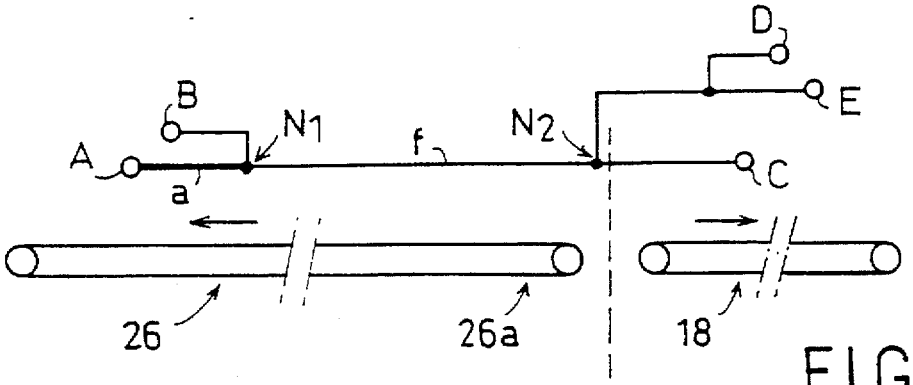

After said branch (a) has been bound by a machine (not shown) which corresponds to the operation shown in FIG. 8, in order to pass to the operation of binding and building up the branch (f), as shown in FIG. 9, the above-described permutation, ordering, and transfer means are used to transfer said end group B from said conveyor 18 to said conveyor 26 and to position it in such a manner that said branch (f) is substantially stretched.

Figure 10:
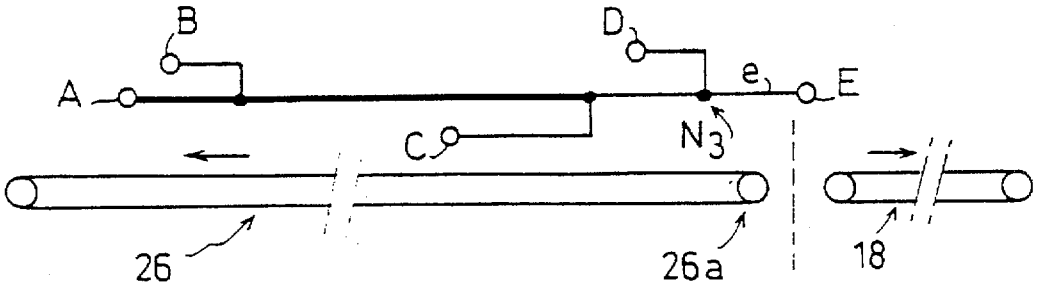

To stretch the branch (e) as shown in FIG. 10, the end group E is kept on said conveyor 18 while all the other end groups, i.e. A, B, C, and D are transferred onto said second main conveyor 26 so as to place those parts of the wire runs which form said terminal branch (e) in the vicinity of the end 26*a* where the binding device (not shown) is situated.

Figure 11:
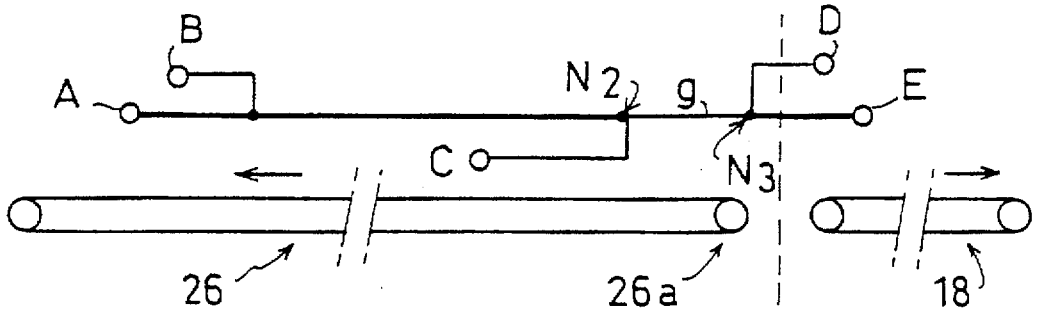

Thereafter, as shown in FIG. 11, it is possible to stretch the central branch (g) by transferring said end group D onto said conveyor 18 while keeping said end groups A, B, and C on said conveyor 26 in positions where those parts of the wire runs that constitute said branch (g) are substantially stretched, thereby enabling them to be bound.

Figure 12:
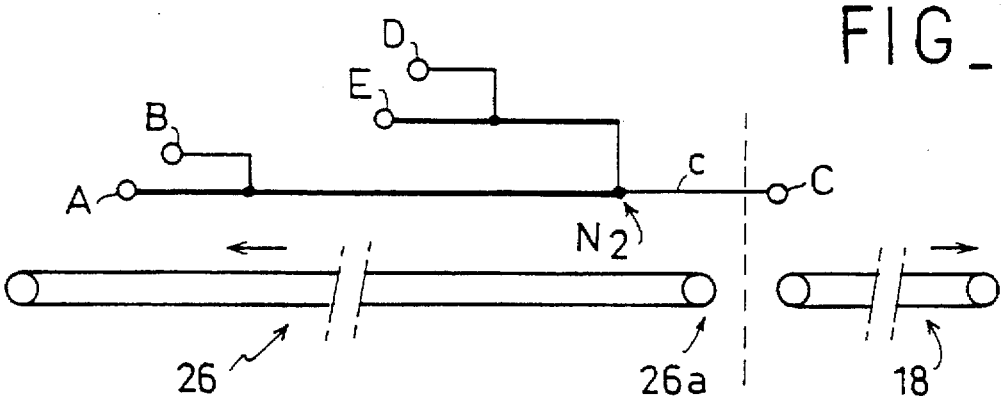

As shown in FIG. 12, it is then possible to stretch and bind terminal branch (c) that has end groups C at one end and node N2 at its other end, with this being done by transferring end group C onto conveyor 18 and transferring end groups A, B, D, and E onto conveyor 26 and moving them to a position in which the wire runs making up the branch (d) are substantially stretched and situated in a zone close to the binding device.

Figure 13:
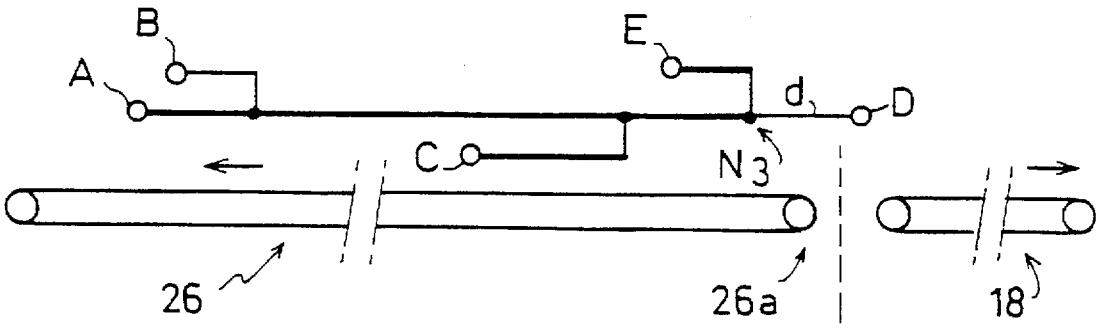

In order to bind the terminal branch (d) situated between said node N3 and said end group D, said end group D is transferred onto said conveyor 18 as shown in FIG. 13, and the other end groups A, B, C, and E are transferred onto said conveyor 26 and moved to positions in which those parts of the wire runs that make up said terminal branch (d) are substantially stretched, thereby enabling it to be bound.

Figure 14:
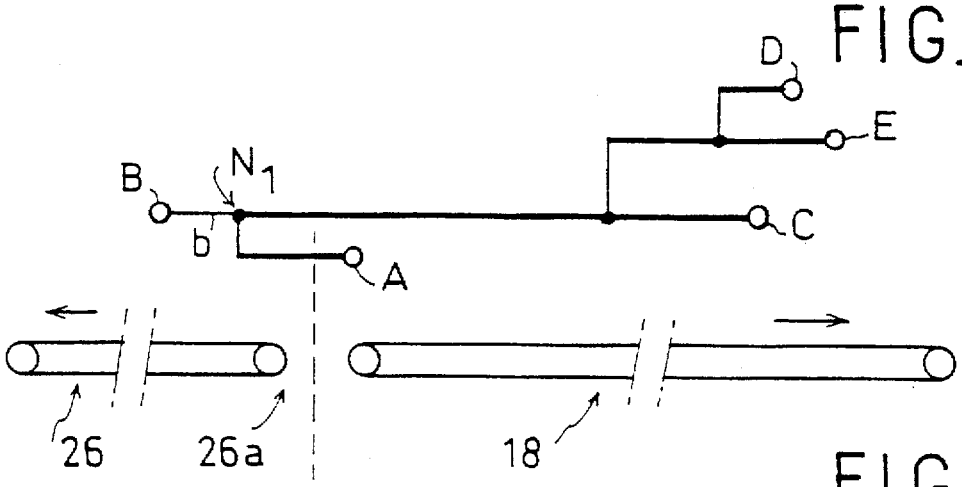

Thereafter, binding of the last terminal branch b of the harness is terminated as shown in FIG. 14 by transferring end group B onto conveyor 26 and transferred end groups A, C, D, and E onto conveyor 18, with said groups being put into relative positions in which those parts of the wire runs that make up said branch (b) are substantially stretched.

With reference to FIG. 21, it can be seen that in a preferred embodiment said intermediate conveyors (39 and 40, with reference to FIG. 6 in particular) when in their intermediate positions in alignment with said upstream and downstream main conveyors, may be driven synchronously with one of said upstream or downstream conveyors by means of a clutch device shown in FIG. 21.

In this figure, it can be seen that said conveyor 18 which extends along said axis $XX_1$ comprises a cog belt 19 provided with corrugations 48 spaced at a pitch 49, which belt is rotated and supported by a pulley or roller 20 of said conveyor that is suitable for rotating about an axis of rotation $YY_1$; a pulley 59 mounted on a shaft common to said pulley 20 is driven simultaneously with said pulley 20 and in turn imparts drive via a belt 57 to a pulley 58 whose axis $YY_2$ is parallel to said axis $YY_1$, which pulley 58 drives a rotary part 55 fitted with a slot 56. When said intermediate conveyor 39 or 40 is in position where it is interposed between said upstream and downstream conveyors, which intermediate conveyor may simply be implemented by a gear wheel 50 provided with teeth 51 having a circumferential pitch 52 close to the said pitch 49 of said cog belts, said gear wheel and/or said conveyor 39 may be set into motion by a rotary part 53 which is constrained to rotate about an axis $YY_2$ of said gear wheel 50 of said intermediate conveyor 39. When said intermediate conveyor 39 is moved along said axis $ZZ_1$ until the axis of rotation of said gear wheel 50 coincides with the axis of rotation $YY_2$ of said pulley 58 of the drive device, the rotary part 53 constrained to rotate with said gear 50 and provided on its outside face either with a projecting blade 54 or with eccentric studs performing the same function, co-operates with the slot 56 provided on the part 55 so as to enable said part 53 to be rotated, thereby rotating said gear wheel under drive from said pulley 58 by means of a coupling of the type generally known by the name Oldham, thus making it possible to avoid motorizing said intermediate conveyor 39 independently and making it possible to transfer end group supports from one of said upstream and downstream main conveyors to the other.

With reference to FIG. 22, the main conveyors 18 and 26 have respective belts 19 and 27 provided with corrugations 48*a* on their outside faces and corrugations 48*b* on their inside faces. Thus, said belts 19 and 27 as driven by said rollers or pulleys 20 and 28 provided with teeth 20A and 28A can cause said end group supports 23, 24 (shown in part) to move in either direction of arrows 32, 33 as a function of forward and reverse control signals, by teeth 47 on the basis of said supports meshing with the teeth or corrugations 48. The mutually parallel axes of rotation $YY_1$, $YY_2$, $YY_3$ of said rollers and of the gear wheel 20, 50B and 28 are perpendicular to said axes $XX_1$ and $ZZ_1$. In the position shown in FIG. 2 where said intermediate conveyor 40 has its top face 40C (serving as a sliding plane for said support) in alignment with the top faces 18C and 26C of said conveyors 18 and 26, said supports 23 and 24 can be transferred from one of said conveyors to the other; naturally, it is necessary for said pitches 49, 47A (of the studs 47) and 52 to be equal, and for the distance 60 between said axes $YY_1$ and $YY_2$ or $YY_2$ and $YY_3$ to be close to (or at least equal to) the length 61 of the bases of said supports 23, 24, 25. In this figure, it can be seen that said moving intermediate conveyors 39 and 40 can be interconnected by means of a rod 43 (shown in part) which is driven in translation along said axis $ZZ_1$ by a single actuator (not shown).

I claim:

1. A method of building a ramified harness of wires, the method comprising;

respectively holding in devices ends of wires to be built into a ramified harness having branches of different combinations of one or more of the wires;

relatively moving the devices so that the devices holding the ends of the wires of opposite ends of one of the branches are respectively on opposite sides of a line and the one of the branches is on one side of the line;

so moving the devices on the opposite sides of the line in opposite directions sufficiently to tension all of the wires;

binding the one of the branches on the one side of the line; and repeating the moving of the devices and binding successively all other of the branches, whereby, when all of the branches are bound, a ramified harness having branches is built.

2. The method of building a ramified harness according to claim 1, wherein the moving of the devices comprises:

operating first and second conveyors for the moving of the devices along an axis; and operating a transfer device selectively transferring from the first to the second conveyor the devices moving along the axis from an end of the first conveyor to an end of the second conveyor for changing an order of the devices along the axis.

3. The method of building a ramified harness according to claim 2, wherein the selective transferring comprises moving at least a selected one of the devices from the conveyors and axis, transferring another of the devices from the first to the second conveyor along the axis and returning the selected one of the devices to the axis and one the conveyors.

4. A method of building a ramified harness of wires, the method comprising:

respectively holding in devices ends of wires to be built into a ramified harness having branches of different combinations of one or more of the wires;

placing the devices holding the wires on one of first and second conveyors for moving the devices along the conveyors, one end of the first conveyor being spaced from an opposite end of the second conveyor and the conveyors being aligned along an axis, whereby the devices are in an order along the conveyors;

providing a transfer device at the ends of the first and second conveyors for receiving and transferring any of the devices moved to the end of the first conveyor from the end of the first conveyor to the end of second conveyor and vice versa along the axis, whereby to control spacing between the devices on the conveyors, and for moving any selected one of the devices received from the ends of the conveyors off the axis while receiving and transferring another of the devices along the axis and then so transferring the selected one of the devices, whereby to change the order of the devices along the conveyor;

so moving, receiving and transferring the devices until the devices holding the ends of the wires of opposite ends of one of the branches are respectively on the first and second conveyors in an order such that movement of the devices then on the first and second conveyors in opposite directions away from the ends of the conveyors tensions the wires of the one of the branches and the one of the branches is on the first conveyor;

binding the one of the first branches with a binding device at the first conveyor; and repeating the moving, receiving and transferring for binding successively all other of the branches, whereby, when all of the branches are bound, a ramified harness having branches is built.

5. An apparatus for building a ramified harness of wires, the apparatus comprising:

first and second conveyor means that respectively receive and move devices along the conveyor means, the devices for holding ends of wires to be built into a ramified harness having branches of different combinations of one or more of the wires, one end of the first conveyor means being spaced from an opposite end of the second conveyor means and the conveyor means aligned along an axis;

transfer means at the ends of the conveyor means that receive and transfer any of said devices from said end of the first conveyor means to said end of the second conveyor means and vice versa, whereby the transfer means is adapted to control spacing between the devices on the conveyor means by controlling the relative movement of the first and second conveyor means, the transfer means being further adapted to move any selected one of the devices off the axis while receiving and transferring the selected one of the devices along the axis, whereby the order of the devices along the conveyor is thereby modified.

6. The apparatus for building a ramified harness of wires according to claim 5, wherein the conveyor means are cogged belt conveyors.

7. The apparatus for building a ramified harness of wires according to claim 6, wherein the transfer means comprises a gear wheel for the receiving and transferring along the axis.

8. The apparatus for building a ramified harness of wires according to claim 7, wherein the transfer means comprises a linear actuator for the moving off the axis.

9. The apparatus for building a ramified harness of wires according to claim 6, wherein the transfer means comprises a linear actuator for the moving off the axis.

10. The apparatus for building a ramified harness of wires according to claim 5, wherein the transfer means comprises a gear wheel for the receiving and transferring along the axis.

11. The apparatus for building a ramified harness of wires according to claim 10, wherein the transfer means comprises a linear actuator for the moving off the axis.

12. The apparatus for building a ramified harness of wires according to claim 5, wherein the transfer means comprises a linear actuator for the moving off the axis.

* * * * *